United States Patent [19]

Wilkinson

[11] 4,357,753

[45] Nov. 9, 1982

[54] CUP LID PIERCING APPARATUS

[76] Inventor: William V. Wilkinson, 2215 Harcourt Crescent, Toronto, Ontario, Canada, L4Y 1W2

[21] Appl. No.: 291,397

[22] Filed: Aug. 10, 1981

[51] Int. Cl.[3] ..... B67B 7/24

[52] U.S. Cl. ..... 30/443

[58] Field of Search ..... 30/443–446; 222/81

[56] References Cited

U.S. PATENT DOCUMENTS

| | | | |
|---|---|---|---|
| 1,315,339 | 9/1919 | Schwartzberg | 30/446 |
| 2,338,592 | 1/1944 | Lorenzen . | |
| 2,584,047 | 1/1952 | Phillips . | |
| 2,595,653 | 5/1952 | Fuller | 30/443 |
| 2,637,898 | 5/1953 | Pontillo | 30/443 |
| 2,639,500 | 5/1953 | Gillespie, Jr. | 30/443 |
| 2,692,427 | 10/1954 | Dettman | 30/443 |

*Primary Examiner*—Frank T. Yost

[57] ABSTRACT

The present invention provides a piercing and cutting apparatus adapted to penetrate flexible lids such as those found on coffee cups and the like. The apparatus comprises a locater portion for locating the apparatus in position on the lid and a piercing member moveable with respect to the locater portion. The piercing member comprises a rigid shaft having a solid lower end and a cutting member projecting downwardly from the lower end of the rigid shaft. The cutting member includes a piercing tip and a plurality of cutting blades which are adapted to distribute pressure over the lid to provide a flap in the lid which is then folded downwardly by the solid lower end of the shaft.

4 Claims, 7 Drawing Figures

FIG. 1.
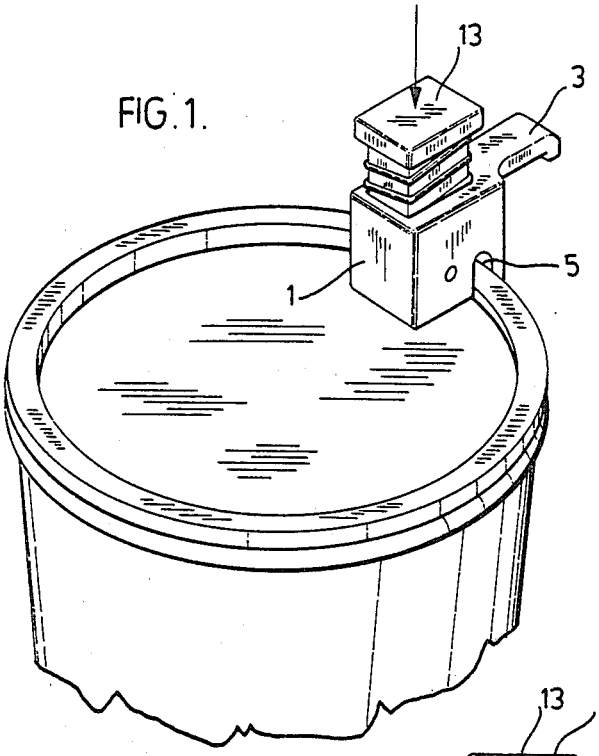
FIG. 2.
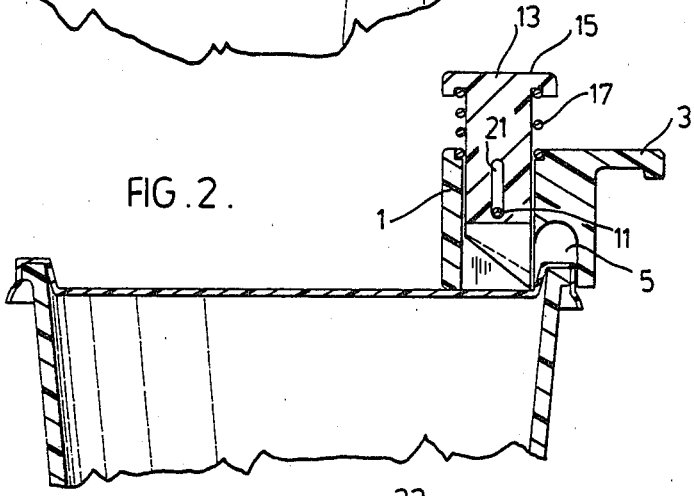
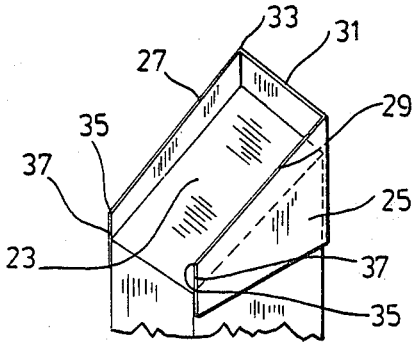
FIG. 3.

FIG. 4.
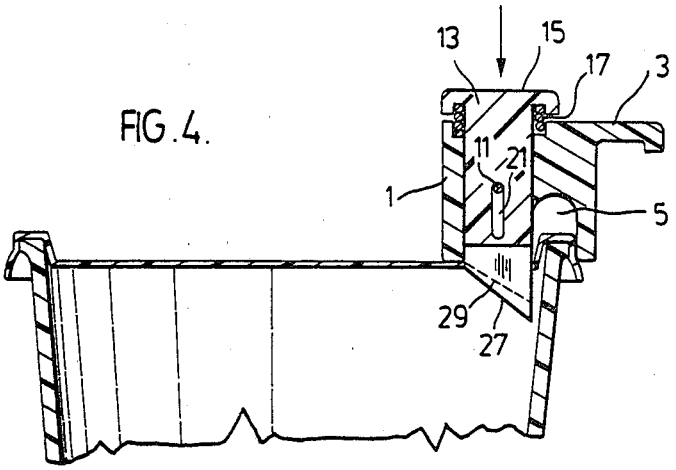
FIG. 5.
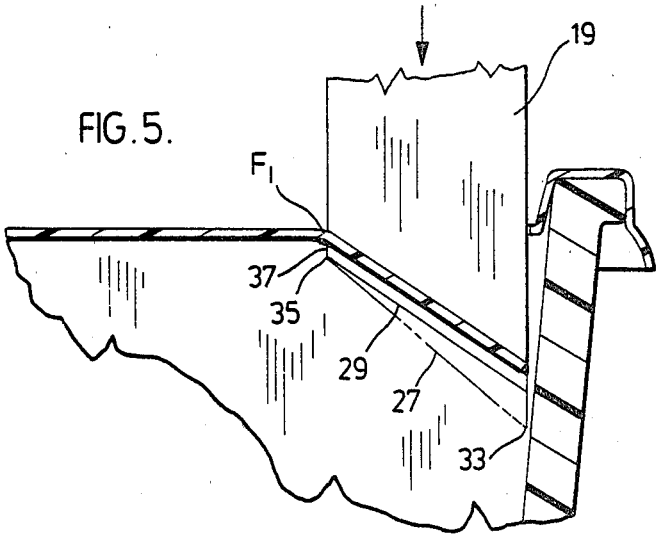
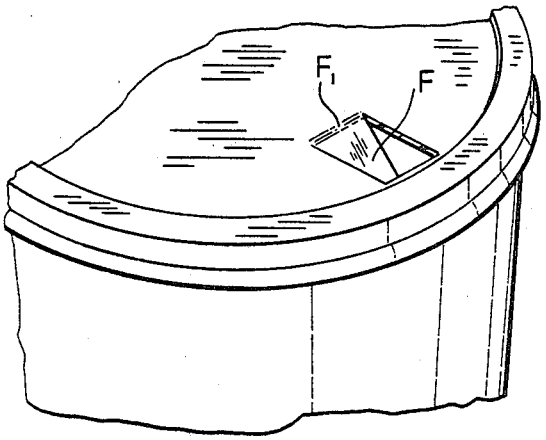
FIG. 6.

CUP LID PIERCING APPARATUS

FIELD OF THE INVENTION

The present invention relates to an apparatus for piercing and cutting container lids and is adapted to be particularly useful in cutting very flexible lids such as those found on coffee cups and the like.

BACKGROUND OF THE INVENTION

There are presently available, a number of different types of hole forming devices for cutting through the lids of different types of cans. These known devices are generally quite efficient when the can lid is metallic and will sustain substantial pressure at one spot on the lid without collapsing the remainder of the lid. However, there are some lids such as those found on coffee cups which will not stand up to the types of pressures applied by these standard can punches. For example, anyone who has tried to push an object through a coffee cup lid will appreciate that the entire lid will often crack before there is any penetration due to the springiness of the lid resulting from its flexibility which is required to properly place the lid on the coffee cup.

In order to drink coffee from the cup with the lid still in position, many people attempt to tear a section of the lid away at the edge of the cup. This feat is extremely difficult to accomplish without unduely tearing the lid or spilling coffee from the cup.

SUMMARY OF THE PRESENT INVENTION

The present invention provides a piercing and cutting apparatus adapted to penetrate flexible lids such as those found on coffee cups and the like. The apparatus comprises a locater portion for locating the apparatus in position at the lid and an operating member moveable with respect to the locater portion. The operating member comprises a rigid shaft with a cutting member projecting downwardly below the lower end of the shaft. The cutting member comprises first and second spaced apart parallel cutting edges which are vertically offset from one another with the first cutting edge being lower than the second cutting edge. The cutting edges are positioned to extend radially of the lid to be pierced and are vertically inclined such that they slope downwardly from front to rear of the cutting member. The lower end of the shaft is solid at least at the front of the cutting member which is open between the parallel cutting edges. The rear of the cutting member is closed by an oblique blade at the rear of the cutting member, which interconnects the two parallel cutting edges. The oblique blade meets with the first cutting edge at a piercing tip on the cutting member.

The piercing tip is adapted to initially pierce the lid after which the first cutting edge and the oblique cutting blade cut into the lid in diverging directions for distributing pressure on the lid until the second cutting edge comes into contact with and cuts the lid parallel to and away from the first cutting edge to provide a flap in the lid. The solid lower end of the shaft which is recessed above the cutting edges drives against the flap after it has been cut in the lid to fold the flap to a downwardly projecting position.

According to this arrangement in which there is an initial piercing of the lid and subsequent cutting by the lower cutting edge, the oblique cutting blade and finally the upper cutting edge, the flexible coffee cup lid has very little tendency to collapse under the pressure applied on it as a result of the distribution and timing of the cuts to provide the flap in the lid. Furthermore, the flap may be cut to a substantial size and is folded out of the way to allow easy drinking from the cup without spilling of the cups' contents.

BRIEF DESCRIPTION OF THE DRAWINGS

The above as well as other advantages and features of the present invention will be described in greater detail according to the preferred embodiments of the present invention wherein:

FIG. 1 is a perspective view looking down on the top of a coffee cup having a plastic lid covering the cup and a preferred embodiment piercing and cutting apparatus in position to cut through the lid;

FIG. 2 is a sectional view showing from one side, the arrangement of FIG. 1:

FIG. 3 is a perspective view showing the bottom end of the piercing and cutting apparatus shown in FIGS. 1 and 2;

FIG. 4 is a view similar to FIG. 2 but showing the operating member after it has pierced and cut into the lid of the coffee cup;

FIG. 5 is an enlarged view of the lower end of the operating member of the arrangement shown in FIG. 4;

FIG. 6 is a perspective view looking down on the coffee cup lid after the flap has been cut and folded downwardly; and, FIG. 7 is an exploded perspective view showing the piercing and cutting apparatus of FIG. 1.

Figure 7:
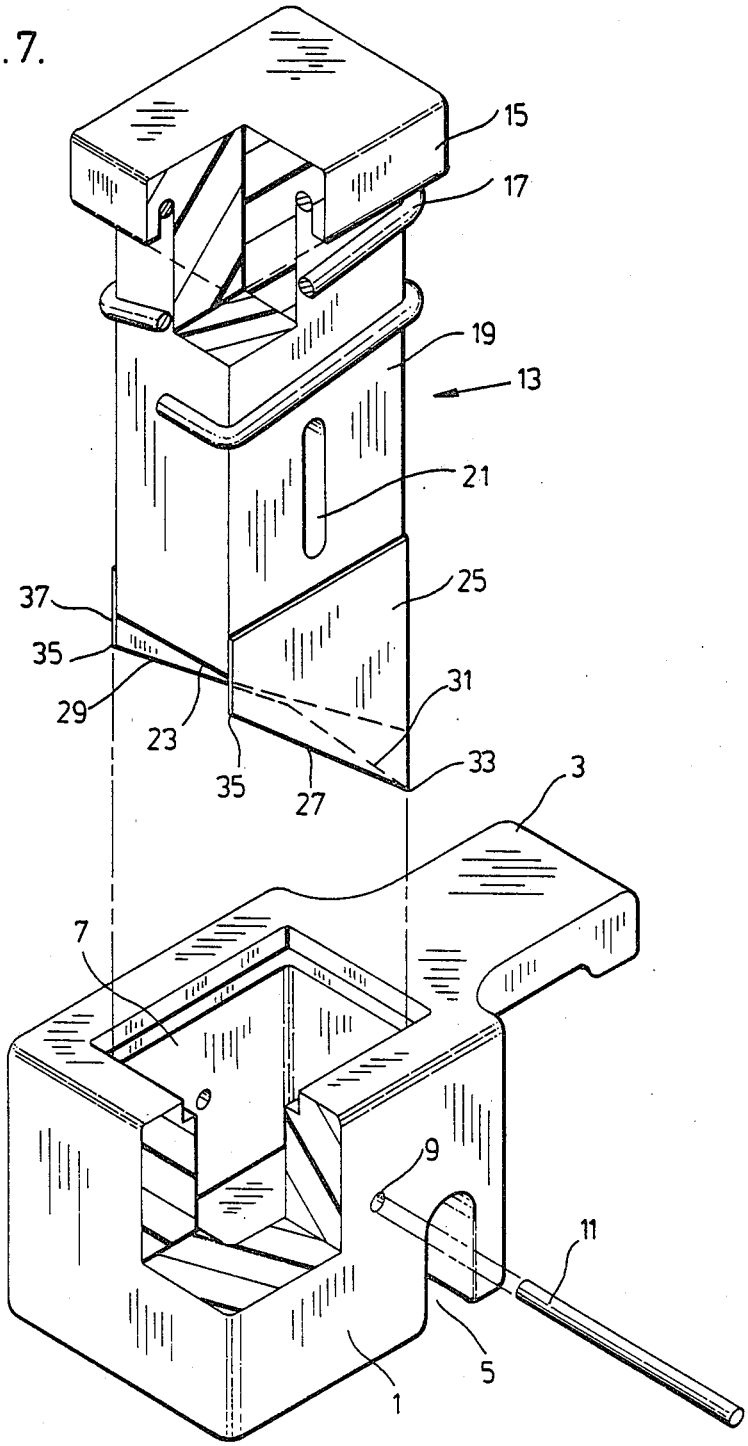

DETAILED DESCRIPTION ACCORDING TO THE PREFERRED EMBODIMENTS OF THE PRESENT INVENTION

Referring first to FIG. 7, the piercing and cutting apparatus comprises a locater portion 1 with an operating member generally indicated at 13 housed in and moveable with respect to the locater portion.

The locater portion is provided with an outwardly projecting handle 3 and a downwardly opening groove 5. The locater portion further includes a rectangular opening 7 for slideably receiving the shaft 19 of the operating member. A pin 11 which is fitted through small openings 9 of the locater portion is received within an elongated groove 21 on the shaft of the operating member to maintain the operating member with the locater portion.

The operating member is further provided with a thumb tab 15 and a spring 17 locked beneath the thumb tab and wrapped around the shaft 19. A cutting member 25 is provided at the bottom of the operating member and extends downwardly beneath the solid lower end 23 of shaft 19.

Cutting member 25 which is best shown in FIG. 3 includes a pair of parallel spaced apart cutting edges 27 and 29. These two cutting edges are vertically offset from one another such that cutting edge 27 extends downwardly below cutting edge 29. The two cutting edges which are downwardly inclined from the front to the back of the cutting member are provided with sharpened corner regions 35 at the open forward ends of each cutting member and are interconnected by an oblique cutting blade 31 at the rear of the cutting member. The oblique cutting blade meets with the lower cutting edge 27 at a piercing tip 33.

As is clearly shown in FIG. 3 the entire cutting member is positioned on the operating member such that the solid lower end of the shaft is recessed above the cutting edges, cutting tip and oblique cutting blade. Accordingly there is a small vertical blade portion 37 on each cutting edge at the front of the cutting member between the sharpened corner regions 35 and the lower end of the shaft.

FIG. 2 shows the piercing and cutting apparatus with the operating member 13 biased by spring 17 to its normal position where the cutting member is hidden within the locater portion. The upward travel of the operating member is stopped by means of pin 11 which prevents the operating member from moving completely out of the locater portion. The elongated vertical groove 21 enables the operating member to be pushed downwardly to the FIG. 4 position.

The operation of the piercing and cutting apparatus is extremely simple and efficient. The apparatus is initially placed on top of the lid with groove 5 fitted over the standard ridge at the edge of the coffee cup as shown in FIGS. 1, 2 and 4. The locater portion is held in position by means of extended handle 3 and downward pressure is applied on the operating member at thumb tab 15. Piercing tip 33 is driven through the lid to initiate the cutting action which is then continued in diverging directions by means of inclined cutting edge 27 and oblique cutting blade 31. This cutting action is continued until the second inclined cutting edge 29 comes into contact with and cuts through the lid parallel to and away from the first cutting edge 27. As the cut is being completed the sharpened corners 35 drive through the lid and the cut is completed by the vertical blade portions 37 between the sharpened corner regions and the lower end of the shaft.

As the cut is being made by the cutting member the lower end of the shaft 23 drives into the flap of material F defined by the cuts and folds the flap downwardly to the FIG. 6 position. As will be seen in FIG. 3, the lower end of the shaft is also inclined so that it runs generally parallel to cutting edges 27 and 29. Therefore, after the initial piercing and cutting has taken place, the lower end of the shaft begins to push on the flap of material before the cutting is completed to fold the flap downwardly and enhance the cutting action of the blades 27 and 29. The sharpened corner regions 35 as well as the vertical blade portions 37, combine with one another to provide a crisp clean cut to either side of the flap immediately adjacent the fold line F1 where the flap is folded downwardly as shown in FIGS. 5 and 6. The cutting action of the corner and vertical blades ensure that the flap maintains its downward position when the apparatus is removed from the lid of the cup.

It is to be appreciated that the size of the cutting member could easily be increased depending upon the size of opening desired through the lid. The lid does not have to be removed from the cup and is quickly and easily penetrated by the apparatus without spilling any of the cup contents. The apparatus is therefore particularly suitable for carry-out coffee cups and the like where the coffee is consumed while driving in the car where it is desireable to keep the lid on the cup so that the coffee does not spill.

The device is extremely inexpensive and the cutting blade can quickly and easily be made from sheet material and the like. Furthermore, the apparatus is extremely portable and with its safety feature in which the cutting member is hidden within the locater portion, can be carried about in one's pocket.

Although various preferred embodiments of the invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A piercing and cutting apparatus adapted to penetrate flexible lids of coffee cups and the like, said apparatus comprising a locater portion for locating the apparatus in position at the lid and an operating member moveable with respect to said locater portion, said operating member comprising a rigid shaft having a lower end with a cutting member projecting downwardly therefrom, said cutting member comprising first and second spaced apart parallel cutting edges, said cutting edges being vertically offset from one another with said first cutting edge being lower than said second cutting edge, said cutting edges being positioned to extend radially of the lid to be penetrated and being vertically inclined such that said cutting edges slope downwardly from front to rear of the cutting member, the front of the cutting member being open between said cutting edges which are interconnected by an oblique blade at the rear of the cutting member, and said lower end of said shaft being solid at least at the front of said cutting member, said oblique blade meeting with said first cutting edge at a piercing tip on said cutting member, said piercing tip being adapted to initially pierce the lid after which said first cutting edge and said oblique blade cut into the lid at about 90 degrees to one another for distributing pressure in substantially perpendicular directions across the lid until said second cutting edge comes into contact with and cuts the lid parallel to and spaced from said first cutting edge to provide a generally rectangular flap in the lid, the lower end of said shaft being recessed above said cutting edges to thereafter drive against and fold the flap to a downwardly projecting position; each of said cutting edges being provided with a sharpened corner region at the open front of said cutting member and a vertical blade between the sharpened corner region and the solid lower end of said rigid shaft, said sharpened corner region and vertical blade portion combining with one another on each of said cutting edges for cutting through the lid to either side of the flap where the flap is folded downwardly by the solid lower end of said shaft.

2. A piercing and cutting apparatus as claimed in claim 1 wherein said solid lower end of said shaft is vertically inclined and parallel with said cutting edges such that said solid lower end of said shaft pushes down on the flap as it is being cut.

3. A piercing and cutting apparatus as claimed in claim 1 wherein said operating member is spring loaded to a safety position in which said cutting member is hidden interiorly of said locater portion.

4. A piercing and cutting apparatus as claimed in claim 1 wherein said locater portion is provided with a downwardly opening groove for seating over a ridge on the lid for locating said apparatus in position.

* * * * *